United States Patent [19]

Ray

[11] Patent Number: 5,012,824

[45] Date of Patent: May 7, 1991

[54] CUTTING MACHINES

[75] Inventor: Eric T. Ray, Salisbury, England

[73] Assignee: GBE International PLC, Hampshire, England

[21] Appl. No.: 460,142

[22] PCT Filed: May 31, 1989

[86] PCT No.: PCT/GB89/00597

§ 371 Date: Mar. 23, 1990

§ 102(e) Date: Mar. 23, 1990

[87] PCT Pub. No.: WO89/11803

PCT Pub. Date: Dec. 14, 1989

[30] Foreign Application Priority Data

Jun. 3, 1988 [GB] United Kingdom ..... 8813195

[51] Int. Cl.[5] ..... A24C 5/39

[52] U.S. Cl. ..... 131/118; 131/117; 131/311; 131/322; 83/931

[58] Field of Search ..... 131/116, 117, 118, 311, 131/322; 83/563, 701

[56] References Cited

U.S. PATENT DOCUMENTS

| | | | |
|---|---|---|---|
| 787,614 | 4/1905 | Dorsey | 83/701 |
| 3,801,024 | 4/1974 | Elsner | 131/118 |
| 4,456,018 | 6/1984 | Brackmann et al. | 131/116 |

FOREIGN PATENT DOCUMENTS

| | | |
|---|---|---|
| 3639693 | 6/1988 | Fed. Rep. of Germany . |
| 694375 | 7/1953 | United Kingdom . |
| 1067448 | 5/1967 | United Kingdom . |
| 1494439 | 12/1977 | United Kingdom . |
| 1498668 | 1/1978 | United Kingdom . |

*Primary Examiner*—V. Millin
*Assistant Examiner*—Lynne A. Reichard
*Attorney, Agent, or Firm*—Dowell & Dowell

[57] ABSTRACT

The present invention provides a rotary drum (22) cutting machine for cutting or shredding lamina material such as tobacco leaf, comprising a support frame (10), means for compressing and feeding material to be cut, as a plug, to a mouth (14) mounted on the support frame, a cutter carriage (20) movably mounted on a track (23) on the support frame, a cutter drum (22) mounted for rotation on said cutter carriage, and drive means (26,27,51,52,28) arranged to move the cutter carriage between an open inoperative position with the cutter drum away from the mouth to a closed operative position to cut or shred material as it issues from the mouth.

14 Claims, 4 Drawing Sheets

CUTTING MACHINES

This invention relates to a rotary drum cutting machine particularly but not exclusively for tobacco or like lamina material.

Examples of such cutting machines are disclosed in United Kingdom Pat. Specifications Nos. 1067448, 1494439, 1498687 and 1498668.

In Patent Specification No. 1498668 there is described an opening and closing mechanism for a tobacco cutting machine, in which a first machine part carries a rotating cutter drum and a second movable part comprises conveyor means for feeding tobacco to said cutter drum to cut the tobacco. The first machine part is capable of effecting a pivoting movement between a closed or operating position where the two parts are closely adjacent each other and an open position.

An object of the invention is to provide a cutter in which the cutter drum is mounted in such a manner that the drum can be moved to a position well clear of the mouth of the compression belts.

Accordingly the present invention provides a rotary drum cutting machine for cutting or shredding lamina material such as tobacco leaf, comprising a support frame, means for compressing and feeding material to be cut, as a plug, to a mouth mounted on the support frame, a cutter carriage movably mounted on a track on the support frame, a cutter drum mounted for rotation on said cutter carriage, and drive means arranged to move the cutter carriage between an open inoperative position with the cutter drum away from the mouth to a closed operative position lo cut or shred material as it issues from the mouth.

Preferably the track is rectilinear and horizontal. Preferably the cutter carriage is movable by means of at least one pneumatic motor which drives a nut located in the carriage and in engagement with a screw threaded rod mounted on the support frame.

According to a further aspect of the invention, a drive belt is provided between a drive pulley on the support frame and a driven pulley mounted on the cutter drum shaft, and tensioning means is provided lo take up any slack in the drive belt when the cutter carriage is moved between the closed and the open positions.

In order to promote a fuller understanding of the above and other aspects of the present invention an embodiment will now be described by way of example only, with reference to the accompanying drawings in which.

Figure 1:
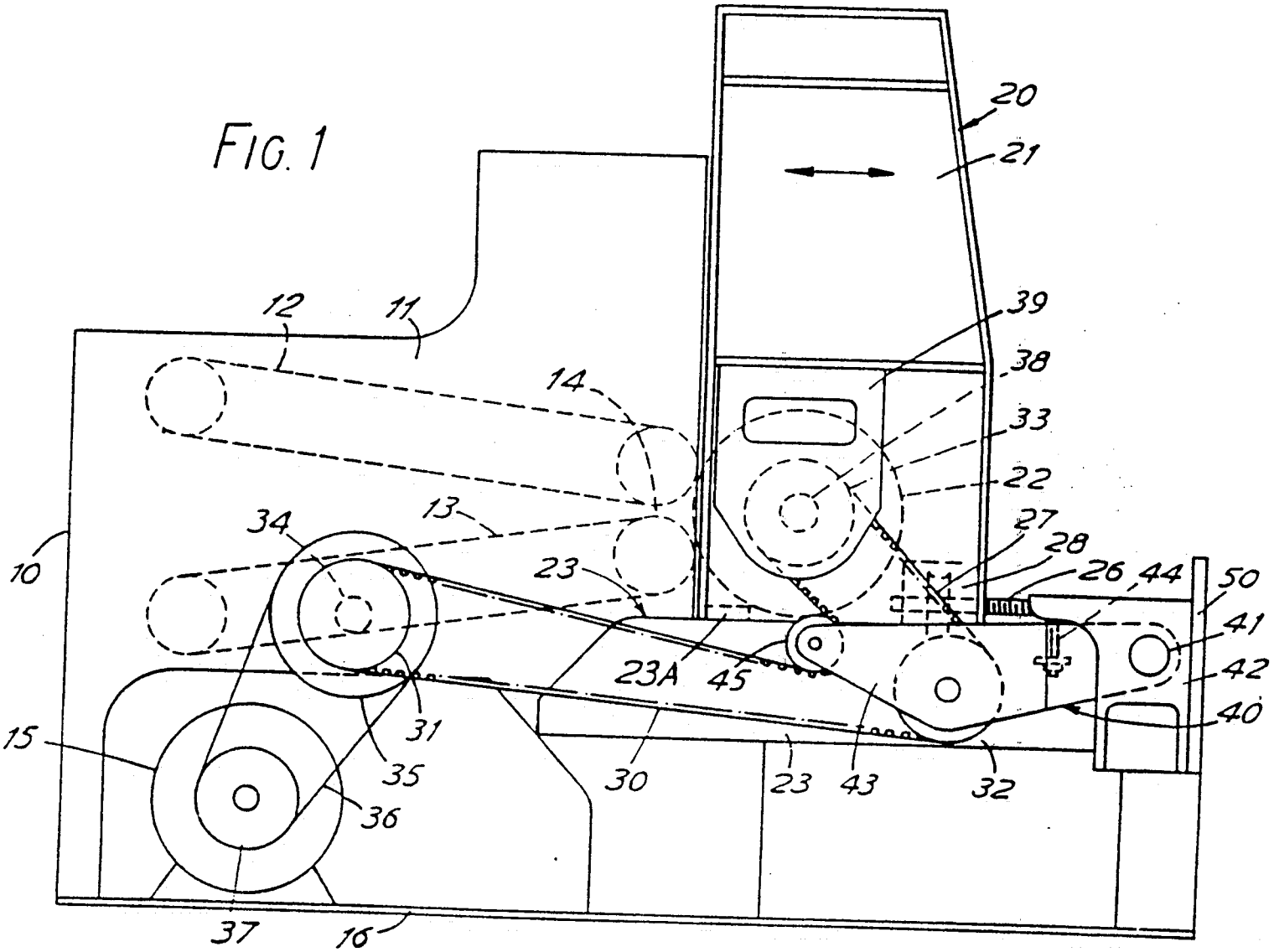
FIG. 1 is a side elevation of a tobacco cutting machine with the cutter carriage in a closed operative condition.

In the tobacco cutting machine shown in the drawings, a supporting frame co comprises a pair of spaced side plates 11 (one only shown) serving to mount bearings for the shafts of the tobacco feed belts 12, 13 which compress the tobacco to be cut and feed it to a mouth

14. A drive mechanism (not shown) for the belts receives power input from an electric motor 15 situated beneath the belts on a base plate 16 of the frame.

A cutter carriage 20 having fabricated end plates 21 carrying between them a cutter drum 22 is arranged for rectilinear movement along a track comprising a pair of rails 23 disposed one on each side of the frame 10. Suitable bearings such as re-circulating idler blocks or bearing rods may be provided as indicated at 23A, between the underside of the carriage 20 and the tracks 23 to reduce friction.

Figure 2:
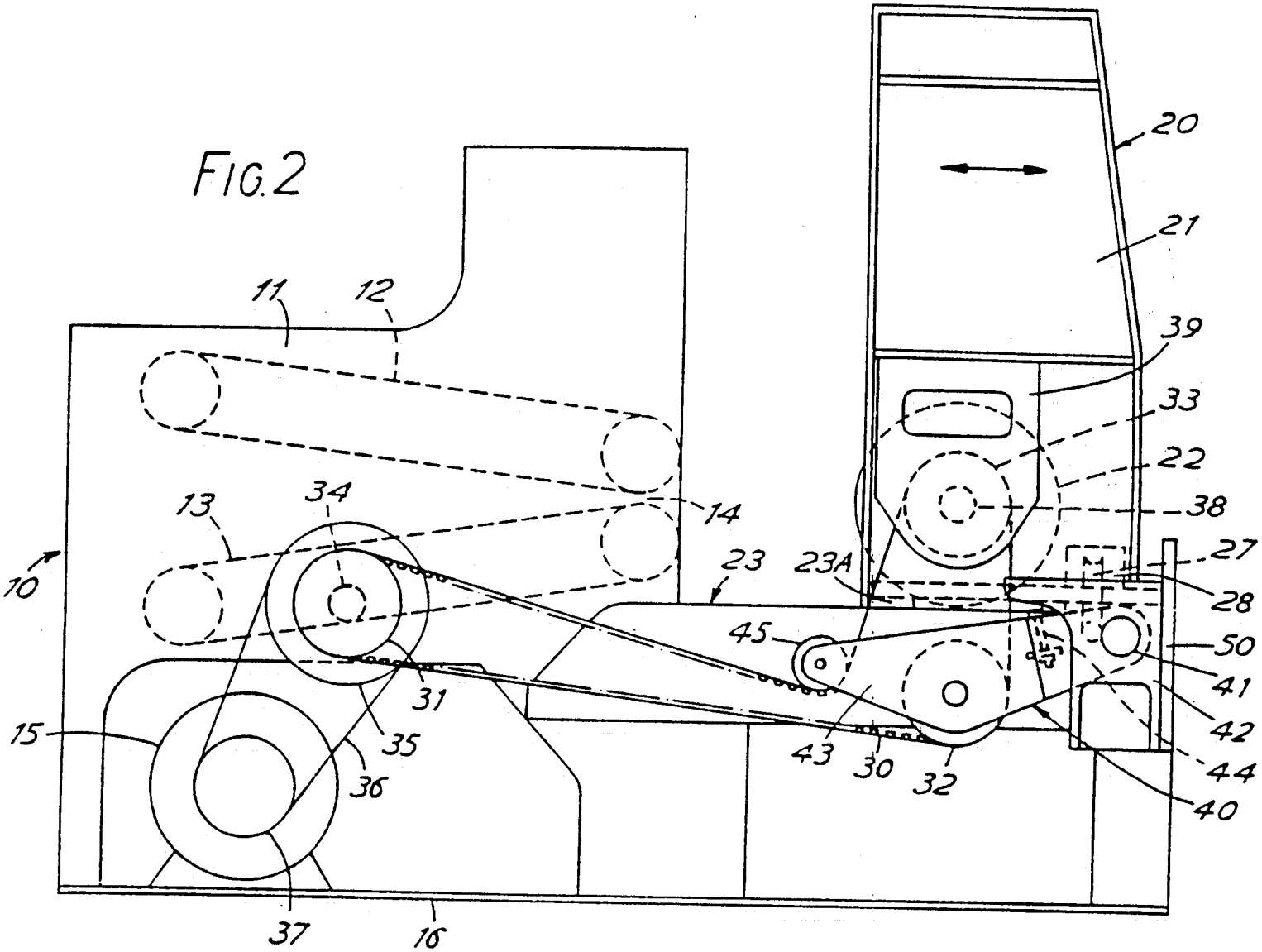
FIG. 2 is a side elevation of the machine of FIG. 1 with the carriage in an open position.
Figure 3:
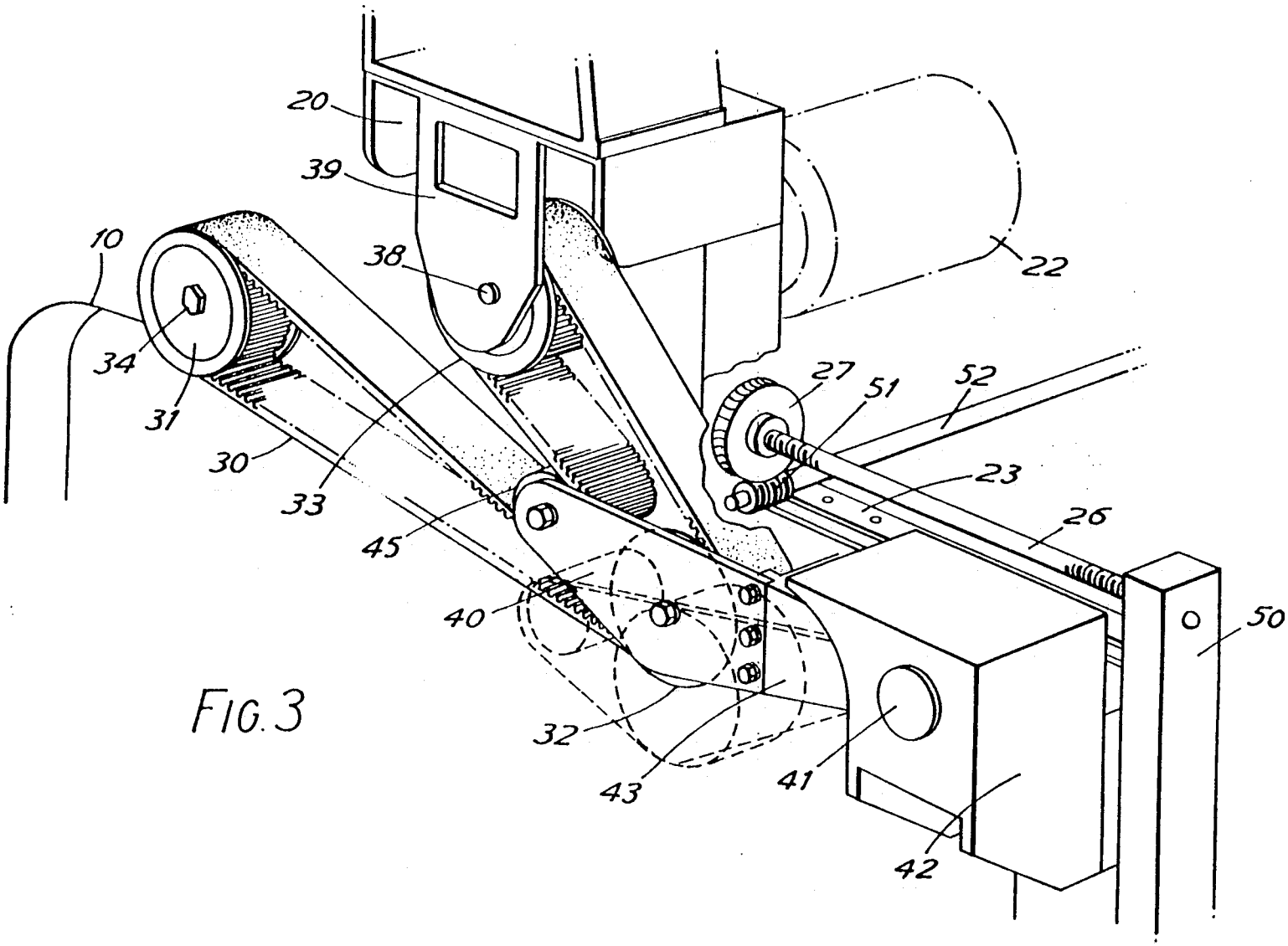
FIG. 3 is a schematic representative view of the drive for the cutter and the drive for the cutter carriage of the machine of FIG. 1.

The carriage 20 is movable between a closed position (FIG. 1) and an open (FIG. 2) position by means of a pair of screw jacks comprising screw threaded rods 26 which are fixed at one end (right in FIGS. 1, 2 and 3) to fixed supports (50) on either side of the frame 10 and respectively nuts 27 which are rotatably mounted in respective sides of the cutter carriage 20, screw threaded on the rods 26. The nuts 27 are each in the form of a worm wheel and arranged to be driven by meshing worm gears 51 which, in turn, are coupled by a cross-shaft 52 and driven by a pneumatic motor shown schematically in FIGS. 1 and 2 at 28.

A toothed drive belt 30 is provided at one side of the frame 10 and passes over a toothed drive pulley 31, a toothed idling pulley 32 and a toothed driven pulley 33, the three pulleys 31, 32 and 33 being of the same diameter and tooth pitch. The pulley 31 is mounted on a shaft 34 on which is fixed a multiple V belt pulley 35 driven via belts 36 from a pulley 37 on the shaft of the motor 15. The pulley 33 is mounted on a shaft 38 which is supported in bearing housings 39 on the cutter carriage 20 and is drivably connected to the cutter drum 22.

The pulley 32 is rotatably mounted on an arm 40 which is pivoted on a shaft 41 carried by a box-like pivot mounting 42 attached to the appropriate side of the frame 10. The arm 40 comprises a pair of mutually parallel side plates 43 connected by cross-plates (not shown). The upper limit of movement of the arm 40 is determined by a screw-adjustable stop member 44 (FIGS. 1 and 2) carried on the arm 40.

A plain-surfaced idler roller 45 is provided at the end of the arm 40 remote from the pivot shaft 41 and together with the toothed pulley 32 and pivoting of the arm 40 serves to maintain the drive belt 30 in tension in all positions of the carriage 20 at and between the open and closed positions thereof.

Figure 4A:
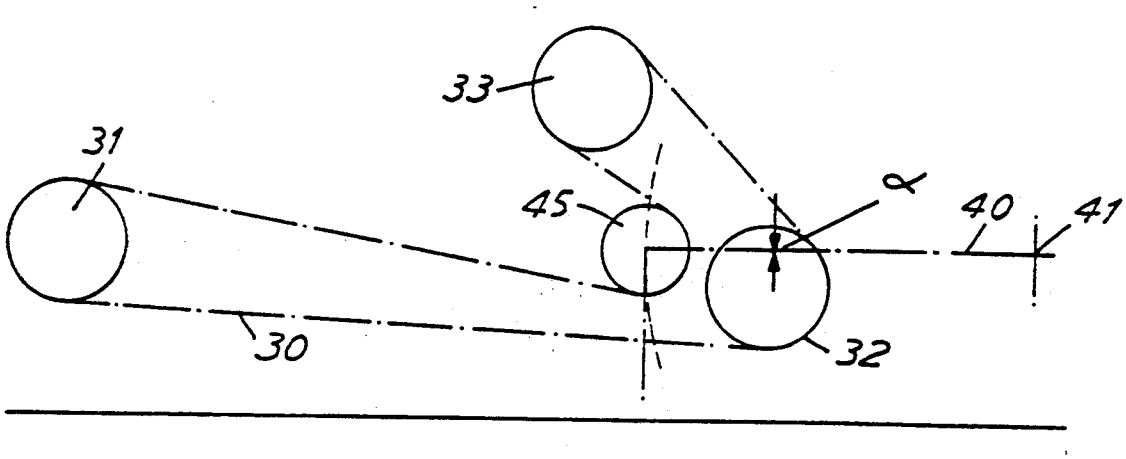
FIGS. 4A, 4B and 4C show schematically the arrangement of the drive belt for the cutter drum in fully closed, intermediate and fully open positions respectively.

The belt 30, as shown in FIG. 1, is under maximum tension suitable for normal cutting operation of the drum 22. In this position the belt 30 holds the arm 40 in its upper end position with the stop 44 firmly engaged against the underside of a top wall of the pivot mounting 42. Since the arm 40 is substantially in a position oF equilibrium the stop 44 is not subject to a high compressive force. This situation is shown schematically :n FIG. 4A. The angle $\alpha$ between the line through the axes of the pulley 45 and pivot 41 and the horizontal is small in this case.

Figure 4B:
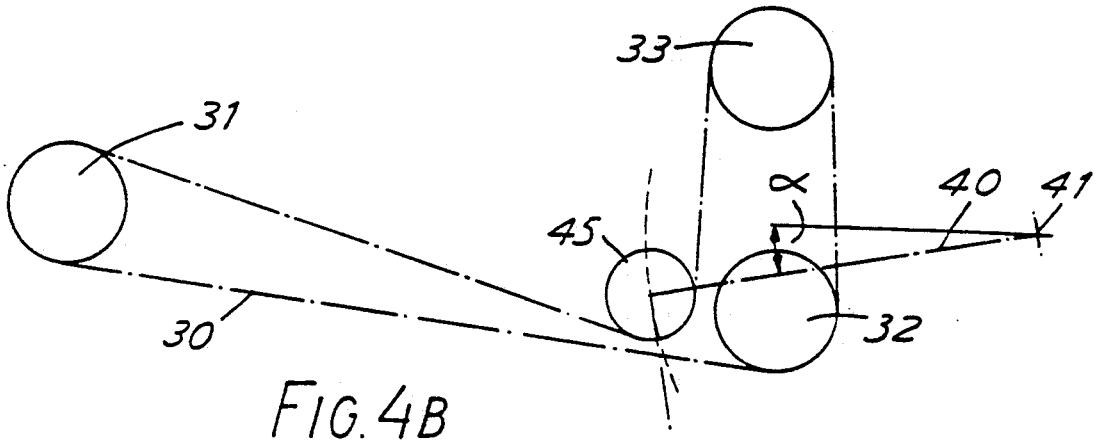
Figure 4C:
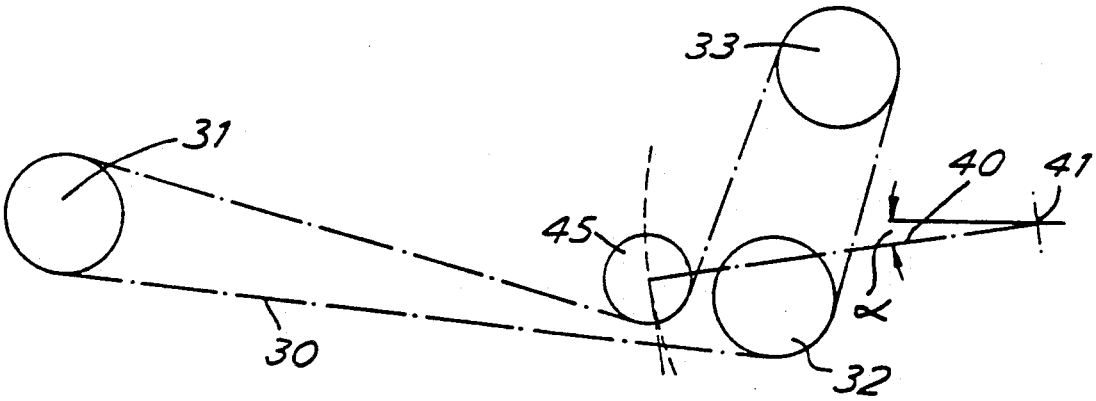

As the carriage 20 is moved away from the closed position by operation of the pneumatic motor 28, the arm 40 drops down due to its own weight and takes up the slack in the belt 30 thus maintaining the tension in the belt 30. On continued withdrawal of the carriage 20 the arm 40 passes through a mid-position of its swing (FIG. 4B) with angle $\alpha$ increasing to a maximum; and then the arm 40 rises to an end position (decreasing angle $\alpha$) where the carriage 20 is in the fully open position as shown schematically in FIG. 4C.

In this manner the drum 22 may be driven in any position of the cutter carriage 20 at and between open and closed, even though the belt 30 may not be fully tensioned in all positions older than when the carriage is closed.

In known machines of this kind, there has been previously experienced the disadvantage that the plug of tobacco at the mouth 14 extrudes therefrom to about 2–3 mm, once the compression belts 12 and 13 have been stopped and the cutter drum 22 has stopped rotating and has been pivoted to an open position. The extruded tobacco plug has to be removed manually or the compression belts reversed before the operation of the machine could be re-commenced.

In the present invention the cutter drum 22 may be set in motion when the carriage 20 is approaching the closed position but is in a slightly open position (2–3 mm open). The carriage 20 may then be driven slowly towards the mouth prior to start-up of the compression belts, whereupon as the cutter blades of the drum 22 approach the mouth 14 the extruded tobacco plug is cut away progressively without suddenly loading the cutter blades and drive as in the prior machine operation.

The advantage of using a pneumatic motor to drive the carriage 20 is that the carriage may be driven under power towards the closed position up to the point where the carriage engages the frame 10 at the end of its travel into the closed position, the pneumatic motor will then merely sit satisfactorily in the stall condition, as compared with an electric or mechanical drive which would overload in such circumstances.

I claim:

1. A rotary drum cutting machine for cutting or shredding lamina material such as tobacco leaf, comprising a support frame, means for compressing and feeding material to be cut, as a plug, to a mouth mounted on the support frame, a cutter carriage movably mounted on a track on the support frame, a cutter drum mounted for rotation on said cutter carriage, and drive means arranged to move the cutter carriage between an open inoperative position with the cutter drum away from the mouth to a closed operative position to cut or shred material as it issues from the mouth.

2. The cutting machine of claim 1, in which said track is rectilinear and horizontal.

3. The cutting machine of claim 1 or 2, in which said track comprises two rails disposed on said support frame, one on each side of said cutter drum.

4. The cutting machine of claim 1 or 2 in which said cutter carriage is provided with anti-friction bearing means to run on said track.

5. The cutting machine of claim 1 in which said cutter carriage drive means includes a nut located for rotation in said cutter carriage and in screw-threaded engagement with a screw-threaded rod mounted on said support frame, and drive means to rotate said nut.

6. The cutting machine of claim 5, in which said cutter carriage drive means includes a pair of said nuts arranged to be driven in synchronism, with respective screw-threaded rods disposed one on each side of said cutter drum.

7. The cutting machine of claim 6, in which each of said nuts is in the form of a worm wheel and said means to rotate said nuts includes a respective worm gear.

8. The cutting machine of claim 1 or 2 in which said cutter carriage drive means includes a pneumatic motor.

9. The cutting machine of claim 1 including a drive pulley on said support frame, a driven pulley on a shaft carrying said cutter drum, a drive belt arranged between said drive and driven pulleys, and tensioning means arranged to maintain tension on said drive belt while said cutter carriage is moved between said open and closed positions.

10. The cutting machine of claim 9, in which said drive belt is a toothed belt, and said drive and driven pulleys are similarly toothed to engage said drive belt.

11. The cutting machine of claim 9 or 10, in which said tensioning means comprises a first idler pulley disposed inside the loop of said drive belt and a second idler pulley disposed outside the loop of the drive belt, said first and second idler pulleys being movably mounted in spaced relationship as an assembly on said support frame.

12. The cutting machine of claim 11, in which said first and second idler pulleys are mounted on an arm which is pivotally mounted on said support frame.

13. The cutting machine of claim 12, in which said arm pivots under gravity to maintain tension in said drive belt.

14. The cutting machine of claim 12 in which abutment means is provided to be operative between said arm and said support frame when said cutter carriage is in the closed operative position thus to maintain full drive tension in said drive belt.

* * * * *